US005378196A

United States Patent [19]

Pinch et al.

[11] Patent Number: 5,378,196

[45] Date of Patent: Jan. 3, 1995

[54] CHILD SWING

[75] Inventors: Daniel R. Pinch, Hope; Dennis M. Turner, Scipio, both of Ind.

[73] Assignee: Cosco, Inc., Columbus, Ind.

[21] Appl. No.: 941,932

[22] Filed: Sep. 15, 1992

[51] Int. Cl.[6] ..... A63G 9/16

[52] U.S. Cl. ..... 472/119

[58] Field of Search ..... 472/119, 118; 185/14, 185/39, 40 C, 44

[56] References Cited

U.S. PATENT DOCUMENTS

| | | | |
|---|---|---|---|
| D. 264,148 | 5/1982 | Gebhard . | |
| 1,418,251 | 5/1922 | Ginsburg | 185/44 |
| 1,571,031 | 1/1926 | Weil | 185/44 |
| 2,975,866 | 3/1961 | Worthington . | |
| 3,459,423 | 8/1969 | Meade | 472/119 |
| 3,526,400 | 9/1970 | Carpenter et al. | 472/119 |
| 3,794,317 | 2/1974 | Barrett | 472/119 |
| 4,165,872 | 8/1979 | Saint . | |
| 4,323,233 | 4/1982 | Gebhard . | |
| 4,452,446 | 6/1984 | Saint . | |
| 4,807,872 | 2/1989 | Spilman et al. . | |
| 5,083,773 | 1/1992 | Saint . | |

FOREIGN PATENT DOCUMENTS

| | | | |
|---|---|---|---|
| 2178669 | 2/1987 | United Kingdom | 472/119 |

*Primary Examiner*—Carl D. Friedman
*Assistant Examiner*—Kien Nguyen
*Attorney, Agent, or Firm*—Barnes & Thornburg

[57] ABSTRACT

A child swing motor apparatus includes a swing motor and a mechanism for using energy discharged from the swing motor to swing a child seat hanging from a child swing frame. The apparatus also includes an indicator for visually indicating the remaining run time of the swing motor during running of the swing motor to swing the child seat. The swing motor includes a spring and a spring winding mechanism. An escapement mechanism is also provided to impart pendulum motion to the swinging child seat using torque generated by the spring.

53 Claims, 8 Drawing Sheets

STOP
FULL
68
38
12
78
70
74
72
76
200
26
240
128
118
116
137
120
110
194
240
24
94
130
124
133
139
154
140
196
135
100
126
151
144
131
95
132
146
122
114
152
145
154
150
162
90
94
96
134
93
92
97
14
164
264
142
266
174
168
38
169
176
86
171
186
172
84
182
166
180
170
83
188
184
185
16
42
226
98
234
119
228
224
44
46
88
84
50
58
230
220
85
42
54
56
48
42
214
238
236
212
216
61
42
167
62
238
60
66
210
238
64
52
222
89
29
12
87
20
27

CHILD SWING

BACKGROUND AND SUMMARY OF THE INVENTION

The present invention relates to swings for children, and particularly to a motor drive assembly and a frame for use in a child swing. More particularly, the present invention relates to a child swing having a quiet-wind spring motor, seat-swinging escapement mechanism, and run-time indicator that can be mounted in a motor housing supported on a sturdy frame and operated to swing a child seat freely in a smooth arc under the motor housing.

Parents and childcare givers understand only too well that a failing of many conventional child swings driven by wind-up spring motors is that their winding mechanisms often make sharp, loud, ratcheting noises when turned to rewind the spring motor. This is quite a problem since it is a common desire to rewind the spring motor while a child is swinging in the child swing so as to extend the run time of the child swing. The unwelcome "winding" noise produced by conventional child swings often startles, disturbs, and awakens a child that is dozing and swinging in the child swing. A child swing that has a quiet wind and run cycle and therefore operates quietly both during normal swinging and spring motor-winding modes would be a welcomed improvement over conventional child swings.

Another problem with conventional child swings is that it is difficult for a parent or childcare giver to judge how long the swing will continue to run before the spring used to drive the swing unwinds to its fully relaxed position and ceases to impart pendulum motion to the child seat. A new and improved child swing outfitted with an easy-to-use run-time indicator would be well received by parents and childcare givers as it would function to provide advance warning and inform nearby persons as to when it will become necessary to approach the child swing and rewind the spring motor so as to maintain smooth uninterrupted operation of the child swing without disturbing the swinging child seated in the swing.

Many conventional child swings exasperate and frustrate users due to the short running time of the spring motor apparatus used to generate the energy for running the child swing. An improved child swing having an extended running time without adding a lot of expensive motor-drive components and manufacturing costs would avoid the well-known shortcomings of many conventional child swings.

Child swings driven by wind-up spring motors are well known. See, for example, U.S. Pat. Nos. 2,975,866 relating to spring motors; 4,165,872 relating to motor-operated swings; 4,323,233 relating to a pendulum swing including a weighted body that glides up and down one of the support legs of the swing; and 5,083,773 relating to a lobe spring motor for a child's swing. It is also known to use an escapement mechanism in a spring-powered child swing as disclosed in the above-noted patents. Child swings driven by electric motors are also well known. See, for example, U.S. Pat. No. 4,452,446 relating to a battery-operated child's swing and 4,807,872 relating to a child swing with upstanding members in abutting relationships.

Many conventional child swings include frames made of four separate poles that mount separately in a housing to provide four separate side legs. See, for example, U.S. Pat. No. 4,165,872 disclosing a canopy having inner end walls provided with upper and lower leg-engaging portions for mounting four separate inclined supporting legs to the canopy. It would be desirable to provide an improved child swing having only two sturdy U-shaped leg assemblies and a spring motor housing configured to mount on the two sturdy leg assemblies. It would be especially desirable to mount these two sturdy leg assemblies to the spring motor housing in such a way as to permit a user to fold the leg assemblies together to collapse the improved child swing from an "expanded" use position to a "flat" storage position to make it easier to transport and store the child swing when not in use. Many conventional child swings are not easily collapsed to a compact folded position so as to simplify transport and storage and are therefore awkward to handle in crowded living spaces often found at home during typical every day use.

According to the present invention, an improved apparatus is provided for swinging a child seat. The apparatus includes a housing, a swing motor coupled to the housing, and means for connecting a child seat to the swing motor so that the child seat swings relative to the housing in response to operation of the swing motor.

Preferably, the improved apparatus includes a run-time indicator. Illustratively, the swing motor includes a spring and means for winding the spring between a relaxed position and a wound position to store energy in the spring. The run-time indicator provides means for indicating a current position of the spring between its wound and relaxed positions so that the amount of stored energy currently left in the spring is displayed as the swing unwinds during swinging of the child seat. In a preferred embodiment, the housing is formed to include a window, an indicator is positioned in the window, and means is provided for moving the indicator in the window as the spring unwinds between its wound and relaxed positions.

The improved apparatus also preferably includes a pair of U-shaped legs that mount to the housing to provide sturdy support for the housing during swinging of the child seat. The housing is long and hollow and includes a crankshaft extending along its length. Each U-shaped leg includes a horizontal top portion interconnecting vertical spaced-apart first and second side leg portions. Desirably, the top portions are mounted in the housing and oriented to lie along the length of the housing in spaced-apart parallel relation to the crankshaft. By pivotally mounting one or both of the top portions to the housing it is possible to pivot one or both of the U-shaped legs relative to the housing to collapse the improved child swing to a compact state that is easily transported and stored when the swing is not in use.

The improved child swing also preferably includes an improved escapement mechanism for using the energy released by the spring as it unwinds to apply one short push to the child seat during each swing cycle to impart pendulum motion to the child seat. The improved escapement mechanism includes a ratchet wheel coupled to the spring and mounted to rotate on the crankshaft, a drive pawl pivotably connected to a hanger arm of the child seat, and a stop pawl arranged to block rotation of the ratchet wheel to prevent unwinding of the spring during disengagement of the drive pawl and the ratchet wheel. The improved escapement mechanism further includes means for allowing the drive pawl to disengage the ratchet wheel during most of each swing cycle and for ramping the pivotable drive pawl into engagement with the ratchet wheel at the end of one swing stroke of the child seat. Advantageously, such extended disengagement of the drive pawl and the ratchet wheel reduces the volume and continuousness of the noise produced by engagement of a drive pawl and a ratchet wheel during operation of the child swing. Thus, the improved child swing runs longer and more quietly than conventional spring-driven child swings due to its improved escapement mechanism.

Moreover, the improved escapement mechanism in accordance with the present invention is designed to simulate true pendulum movement more closely by positively driving the child seat to maintain swinging motion for only a short time during each swinging cycle and thereby increasing the amount of free-swinging pendulum motion of the child seat during each swinging cycle. Advantageously, this type of drive provides a more swing-like sensation for the child seated in the child seat to provide a more comfortable and relaxing ride.

Also, in preferred embodiments, a one-way clutch is mounted in the ratchet wheel to permit a user to rewind the spring without interrupting swinging movement of the child seat. Illustratively, the one-way clutch is coupled to the spring and mounted on the crankshaft to engage an inner edge of the ratchet wheel. By turning the crankshaft in a spring-winding direction, a user can rotate the one-way clutch (without rotating the ratchet wheel) to wind the spring quietly without disturbing the swinging movement of the child seat or interrupting the operation of the escapement mechanism. Once the rewinding step has been completed, the one-way clutch automatically reestablishes driving engagement with the rotatable ratchet wheel to transmit energy released from the unwinding spring to the escapement mechanism.

Additional objects, features, and advantages of the invention will be apparent to those skilled in the art upon consideration of the following detailed description of a preferred embodiment exemplifying the best mode of carrying out the invention as presently perceived.

BRIEF DESCRIPTION OF THE DRAWINGS

The detailed description refers to the accompanying figures in which.

DETAILED DESCRIPTION OF THE DRAWINGS

Figure 1:
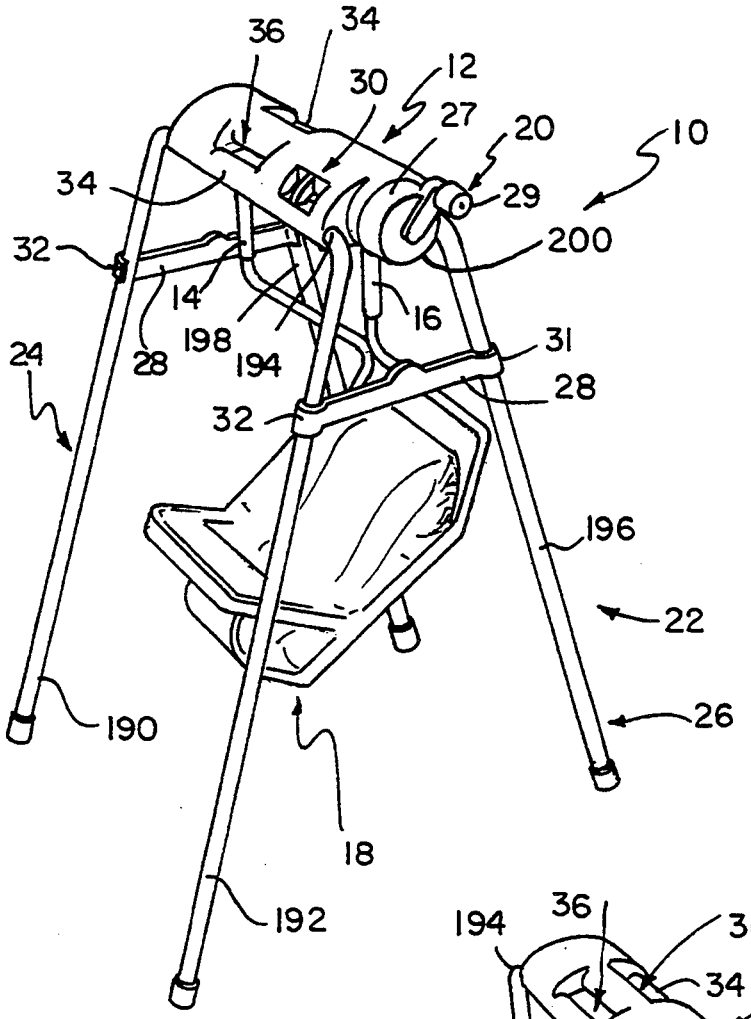
FIG. 1 is a perspective view of a child swing in accordance with the present invention set up in a ready-to-use position.

A child swing 10 in accordance with the present invention is shown in FIG. 1. The child swing 10 is set up in a ready-to-use position and includes a swing motor housing 12, a pair of swinging hanger arms 14, 16, a child seat 18 of any suitable size and shape, a crank handle 20, and a frame 22. The frame 22 includes a front U-shaped leg 24 mounted to the front edge of the swing motor housing 12, a rear U-shaped leg 26 mounted to the rear edge of the swing motor housing 12, and a pair of removable leg braces 28. Crank handle 20 includes a hollow tapered shell 27 and a hand grip 29 as shown in FIGS. 1–3.

The crank handle 20 can be turned to wind up a spring motor (FIG. 4) mounted in the swing motor housing 12. The child seat 18 swings automatically back and forth along a smooth arc under the swing motor housing 12 as the spring motor unwinds in the manner described in a later section of this detailed description. A run-time indicator 30 is provided in swing motor housing 12 to make it easy for nearby persons to monitor how long the spring-powered child swing 10 is expected to continue to run before the spring motor fully unwinds and ceases to impart pendulum motion to the child seat 18 through hanger arm 16.

Figure 2:
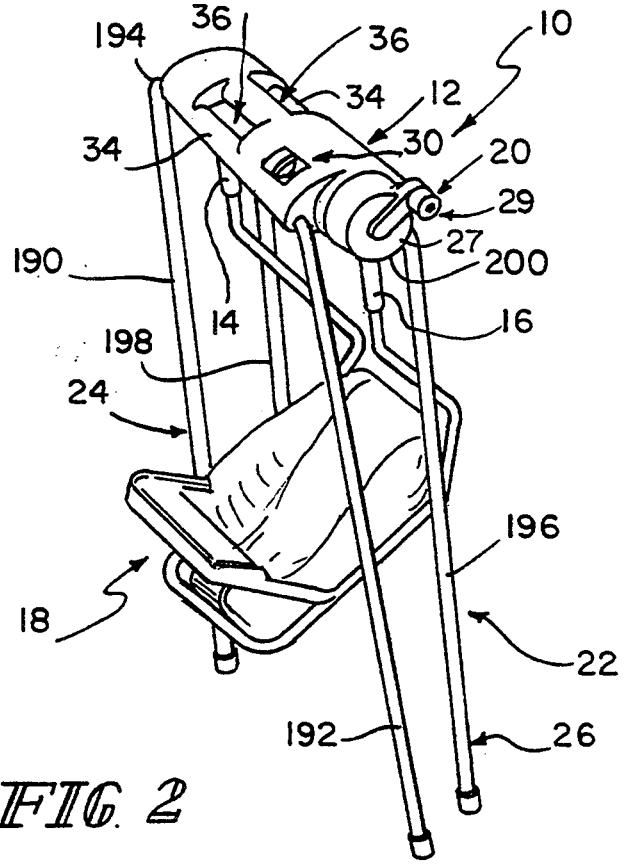
FIG. 2 is a view similar to FIG. 1 showing the child swing following removal of the side braces and folding of the frame to a collapsed position ready for transport or storage.
Figure 3:
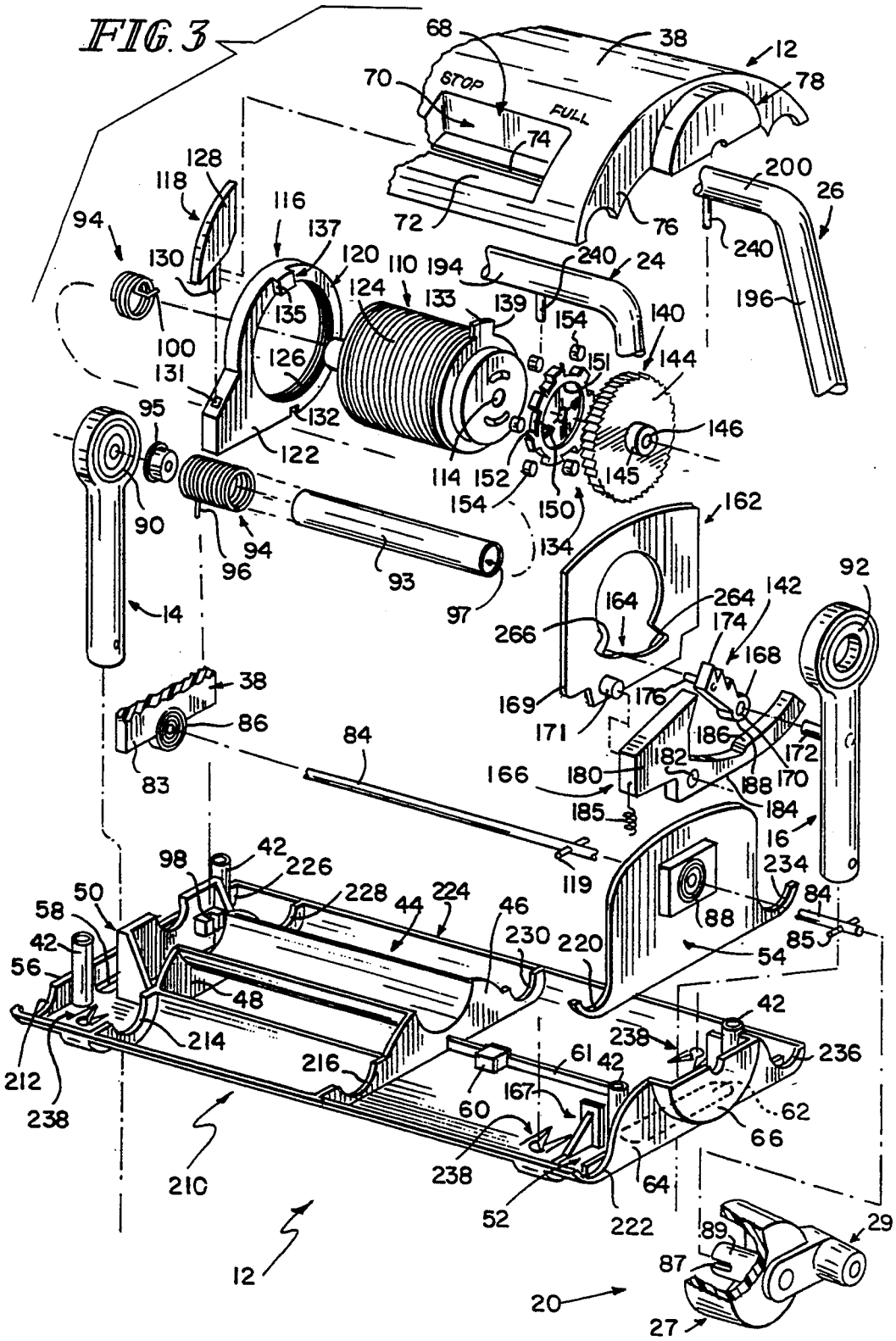
FIG. 3 is an exploded perspective view of the swing motor housing showing the components of the motor used to swing a child seat suspended from the swing motor housing.

The child swing 10 can be folded as shown in FIG. 2 for easy storage and transport. The front U-shaped leg 24 is mounted to the front edge of housing 12 so that it can be pivoted from a spread position shown in FIG. 1 to a folded position shown in FIG. 2. Once the two leg braces 28 are removed, the U-shaped front leg 24 can be unlocked and pivoted relative to housing 12 to collapse the child swing 10. The releasable leg-locking assemblies in clamshell housing 12 will be described below in connection with the discussion of FIGS. 5 and 6. Each leg brace 28 includes, for example, on one end a snap-on clamp 31 formed to snap onto the rear leg and on the other end a snap-on clamp 32 formed to snap onto the front leg. It will be understood that many kinds of braces could be used to hold the front and rear U-shaped legs 24, 26 in the locked, spread position shown in FIG. 1.

The front side of swing motor housing 12 is also formed to provide a carrying handle 34 adjacent to the run-time indicator 30 to make it easy for a person to grip and carry the child swing 10. An elongated aperture 36 extends along the back side of carrying handle 34 to receive the fingers of a person gripping the carrying handle 34. Conveniently, another carrying handle 34 and finger-receiving aperture 36 are formed along the back side of the swing motor housing 12 to make it easy for a person approaching the child swing 10 from the rear to grip and lift it.

The components mounted inside the swing motor housing 12 and used to swing the child seat 18 and monitor the run time of the child swing 10 are shown prior to assembly in FIG. 3. Housing 12 is preferably a clamshell design and includes a top half shell 38 and a complementary bottom half shell 40. Advantageously, in this clamshell design, the swing motor components are fully encased in housing 12 and therefore not easily accessed by a child riding in child swing 10 or standing nearby child swing 10.

The bottom half shell 40 functions as a base and includes a plurality of mounting posts 42 for supporting the top half shell 38, a spring guard 44, a pair of spaced-apart spring guard support walls 46, 48, a first crankshaft support 50 to the left of spring guard 44, and channel means 52 for receiving a drop-in second crankshaft support 54 to the right of spring guard 44. The bottom half shell 40 is also formed to include a low left end wall 56, a first hanger arm-receiving aperture 58 adjacent to first crankshaft support 50, a first run-time indicator stop 60 adjacent to spring guard support wall 46, a straight run-time indicator guide rail 61 extending between wall 46 and channel 52, a second hanger arm-receiving aperture 62 adjacent to channel means 52, and a medium height right end wall 64 formed to include a horizontally extending bottom semicircular platform 66. It will become clear as this description progresses that the configuration of the top and bottom half shells 38, 40 and the other components in swing housing 12 cooperate to provide a modular child swing motor assembly that can be manufactured and assembled in an economical manner.

Figure 4:
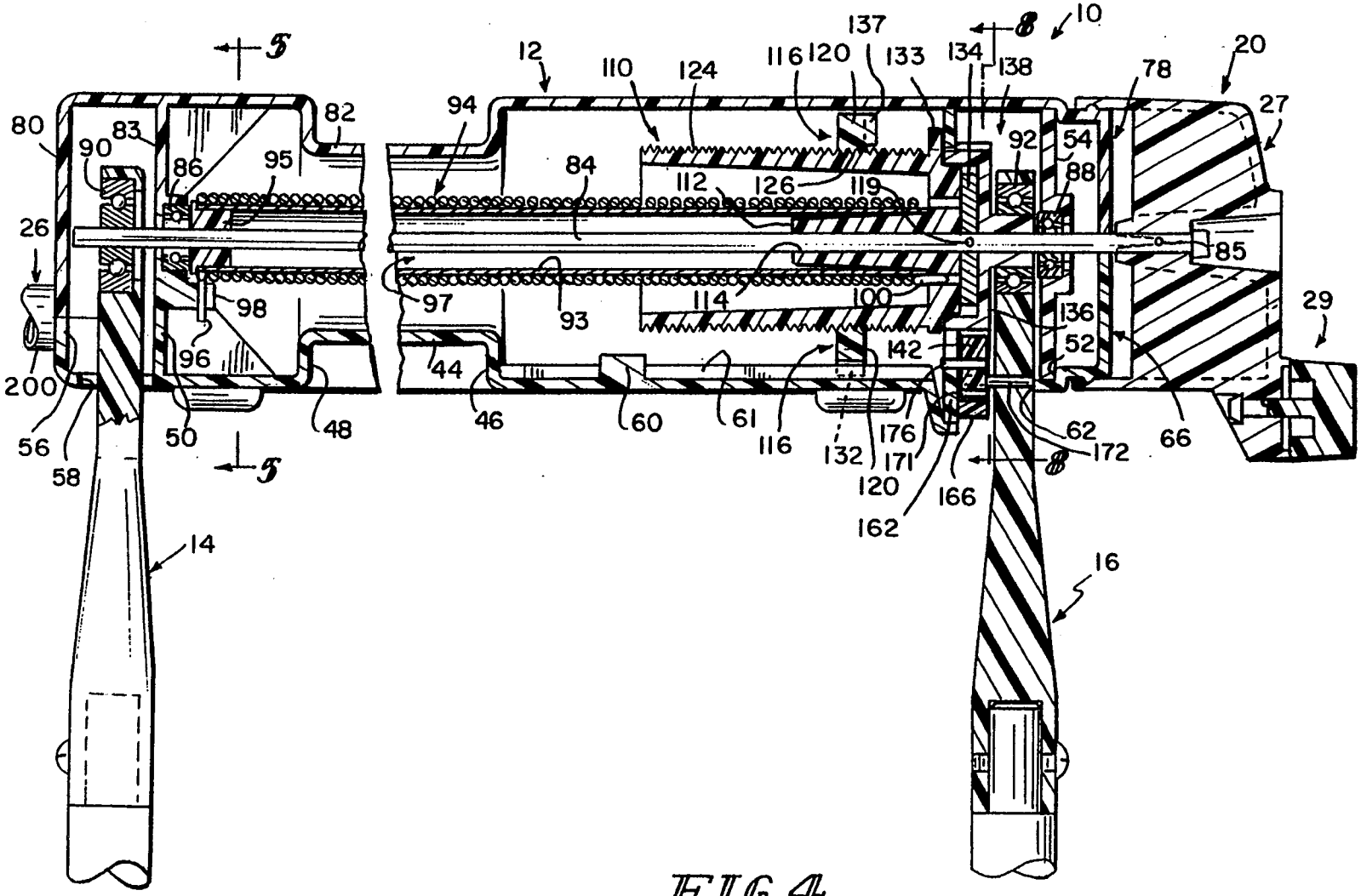
FIG. 4 is a longitudinal sectional elevation view of the assembled swing motor taken along line 4—4 of FIG. 5 showing a handle-driven crankshaft, a pair of hanger arms mounted on the crankshaft, a spring motor along the crankshaft, a rotating barrel with run-time indicator, a one-way clutch coupled to the barrel, and an escapement mechanism for using torque generated by the spring motor and transmitted by the barrel and one-way clutch to impart pendulum motion to the pivotable hanger arms and child seat attached to the hanger arms.

The top half shell 38 functions as a cover for the bottom half shell 40 and is formed to include a window 68 for viewing the run-time indicator 30 as it moves during unwinding of the spring motor. Illustratively, the top shell half 38 includes a recessed area 70 having a bottom wall 72 formed to include an elongated slot 74 so as to provide a window 68 of the type just described. The top half shell 38 also includes a right end wall 76 having a horizontally extending top semicircular platform 78. Once the top and bottom half shells 38, 40 are assembled to provide the clamshell housing 12, the right end wall 76 of the top half shell 38 mates with the right end wall 64 of the bottom half shell 40 so that the two horizontally extending semicircular platforms 66, 78 mate. As shown in FIG. 4, the top half shell 38 also includes a left end wall 80, a top spring guard 82 located to lie above the bottom spring guard 44, and a downwardly extending plate 83 configured to mate with the upwardly extending first crankshaft support 50 to hold bearing 86 in place inside housing 12.

Referring to FIGS. 3 and 4, a crankshaft 84 is arranged to extend inside and along the length of housing 12 to provide means for supporting the pivotable hanger arms 14, 16, the run-time indicator 30, and the spring motor. The left end of the crankshaft 84 is journaled in a bearing 86 mounted on the first crankshaft support 50 and a right end of the crankshaft 84 is journaled in a bearing 88 mounted on the second crankshaft support 54 so that the crankshaft 84 will rotate easily about its longitudinal axis in response to turning the crank handle 20 about that axis. A cross pin 85 is appended to the right end of the crankshaft and sized to engage a slot 87 formed in a hub 89 included in crank handle 20. Left hanger arm 14 includes a bearing 90 receiving the left end of crankshaft 84 therein and right hanger arm 16 includes a bearing 92 receiving the right end of crankshaft 84 therein. By using such bearings to support the crankshaft 84 and hanger arms 14, 16, it is possible to reduce noise and wear caused by swinging of the child seat 18 and to reduce friction so as to extend the run time and increase the arc length of the swing path.

By now it will be clear that a wind-up spring motor is used to swing the child seat 18. Advantageously, the spring motor included in child swing 10 is designed to wind and unwind quietly so as to operate without disturbing a child swinging in child seat 18. In child swing 10, the spring motor can be wound quietly at any time, even when the child seat 18 is swinging back and forth underneath clamshell housing 12 because of the novel clutch and ratchet and pawl escapement mechanism included in child swing 10.

As shown best in FIGS. 3 and 4, an elongated, coiled torsion spring 94 is mounted in housing 12 and used as a motor to generate enough torque to swing child seat 18. Spring 94 is mounted to extend along and about crankshaft 84 and includes a first end 96 anchored to the housing 12 at a lock 98 appended to first crankshaft support 50. It will be understood that first end 96 can be coupled to housing 12 in a variety of locations using any one of several known techniques. Spring 94 also includes a second end 100 that is anchored to another part of the drive mechanism (e.g., barrel 110) so that turning of the crank handle 20 about the longitudinal axis of crankshaft 84 will cause the spring 94 to be wound from a fully relaxed position to a fully wound position.

By winding the spring 94, energy is stored in the spring 94 which later can be released in a quiet, controlled way to impart pendulum motion to the hanger arms 14, 16 and the child seat 18. As shown in FIG. 4, tubular coiled spring 94 is supported by an elongated spring support tube 93 that is supported at its left end by crankshaft bushing 95 and at its right end by a core 112 included in barrel 110. The elongated tube 93 includes a central passageway 97 and the crankshaft 84 is mounted to extend through that passageway and support bushing 95 and barrel core 112.

Advantageously, child seat 18 is suspended by hanger arms 14, 16 to swing about the longitudinal axis of crankshaft 84 which is surrounded by the spring support tube 93 and elongated torsion spring 94. The spring 94 is a medium torque soft winding spring which is easy to wind but generates enough torque to swing the child seat 18 due, in part, to the low friction bearings. The child seat 18 swings through a nice long arc to provide safe, smooth swinging movement during operation of the child swing 10. Also, the child swing 10 is strengthened and quieted by using four bearings 86, 88, 90, 92 to support the rotatable crankshaft 84 and the pivotable hanger arms 14, 16. Moreover, this configuration makes the child swing 10 very easy to assemble which leads to better product quality and lower manufacturing costs.

The various components included in the run-time indicator 30 are shown in an unassembled state in FIG. 3 and an assembled state in FIG. 4. Run-time indicator 30 includes a rotatable barrel 110 including a core 112 formed to include a crankshaft-receiving aperture 114 extending along the length of the barrel 110, a collar 116, and an indicator 118. A cross pin 119 is appended to crankshaft 84 as shown in FIG. 3 and used to connect barrel 110 to crankshaft 84. In use, barrel 110 rotates about the longitudinal axis of crankshaft 84 as the spring 94 unwinds to move the collar 116 and indicator 118 from a far-right position in the top shell half window 68, which represents a fully wound state of spring 94, to a far-left position in the top shell half window 68, which represents a fully relaxed or unwound state of the spring 94. Thus, by observing the position of the indicator 118 in window 68, it is easy for a bystander to judge approximately how long the child swing 10 is expected to run before the spring 94 fully unwinds.

The collar 116 is the part of the run-time indicator 30 that moves back and forth along the crankshaft axis in response to winding and unwinding of spring 94. The collar 116 includes a mounting ring 120 and an indicator support 122 projecting radially outwardly with respect to the center of mounting ring 120. The cylindrical barrel 110 includes a threaded exterior wall 124 and the mounting ring 120 is formed to include an aperture 126 threaded to engage the threaded exterior wall 124 of the barrel 110. The indicator 118 includes a flag 128 and a post 130 that is insertable in a bore 131 formed in the indicator support 122 to permit the indicator 118 to be mounted on and carried by the collar 116 as it travels back and forth along the barrel 110 during winding and unwinding of the torsion spring 94.

In run-time indicator 30, the collar 116 is limited to back and forth movement along the longitudinal axis of crankshaft 84 so that it can move the indicator flag 128 back and forth in the top shell half window 68 as the barrel 110 is rotated. It is important that the collar 116 is blocked by the guide rail 61 or other rotation-blocking member so that collar 116 cannot rotate about the longitudinal axis of the crankshaft 84 during rotation of the barrel 110. For that reason, the collar 116 is formed to include a downwardly opening slot 132 sized to receive and ride on the straight guide rail 61 formed on the bottom wall of the bottom shell half 40 as the collar 116 moves relative to the barrel 110 during winding and unwinding of spring 94. Such engagement of the guide rail 61 in collar slot 132 permits the collar 116 to reciprocate along the longitudinal axis of the crankshaft 84 in response to rotation of the barrel 110 without allowing the collar 116 to rotate with the barrel 110 about the longitudinal axis of the crankshaft 84.

The movement of collar 116 and indicator flag 118 back and forth along barrel 110 is limited on the left side by the first run-time indicator stop 60 that is mounted on the bottom wall of bottom half shell 40 adjacent to the right spring guard support wall 46 as shown best in FIG. 4. It will be understood that the bottom portion of indicator support 122 will engage the first run-time indicator stop 60 to limit further movement of collar 116 toward spring guard 44 as the spring 94 unwinds. A second run-time indicator stop 133 is formed on the right end of barrel 110 as shown in FIGS. 3 and 4. A stop face 135 on stop member 137 on mounting ring 120 will engage a complementary stop face 139 on the second run time indicator stop 133 to limit further movement of collar 116 away from spring guard 44 as the crankshaft 84 is rotated to wind spring 94. This is a physical stop to prevent overwinding of spring 94. Advantageously, the two run-time indicator stops 60, 133 provide positive zero-friction stops that limit movement of the run-time indicator 30 without adding any frictional drag to the spring motor during winding and unwinding of spring 94. The stop faces 135 and 139 are either engaged or disengaged and do not add any frictional drag during unwinding of spring 94.

Figure 8:
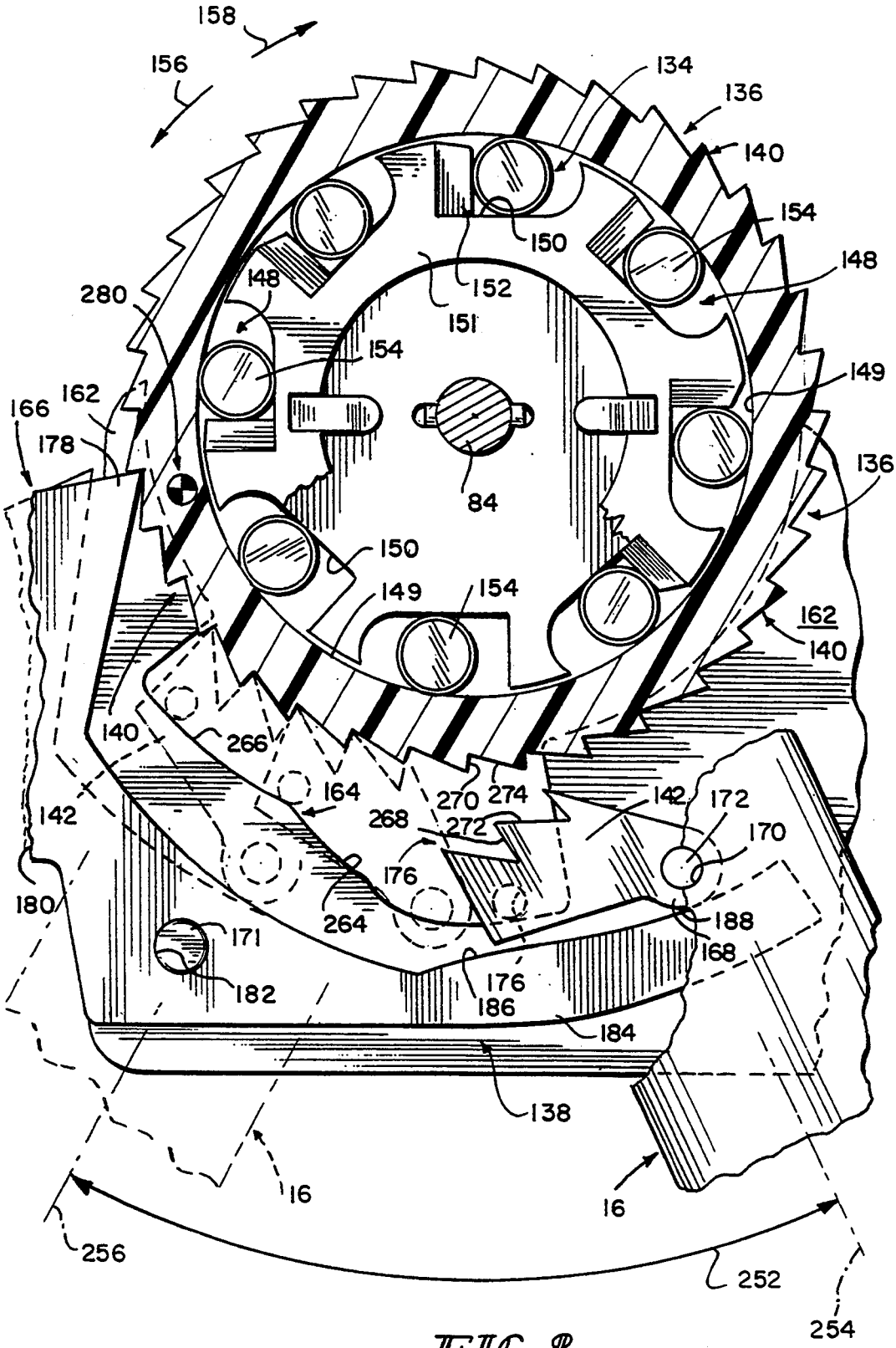
FIG. 8 is an enlarged elevation view of the escapement mechanism taken along line 8—8 of FIG. 4 showing the one-way clutch inside the ratchet wheel and the range of movement of the stop pawl and drive pawl relative to the ratchet wheel during swinging of the hanger arms and the child seat.

As shown best in FIG. 4, a one-way clutch 134 is mounted on crankshaft 84 next to the barrel 110 and used to rotate a ratchet wheel 136 (also mounted on crankshaft 84) in response to rotation of the barrel 110 included in the run-time indicator 30. This one-way clutch 134 is keyed to the barrel 110 as shown in FIG. 8 and only disengages ratchet wheel 136 during winding of spring 94 and otherwise is engaged to drive the ratchet wheel 136. The ratchet wheel 136 is mounted to turn freely on crankshaft 84 and is part of an escapement mechanism 138 which functions to impart pendulum motion to the child seat 18 via the right hanger arm 16 during unwinding of spring 94. Essentially, as the spring 94 unwinds, it rotates the barrel 110, which rotates the one-way clutch 134, which rotates the ratchet wheel 136, which operates the escapement mechanism 138 to give a small push to the hanger arm 16 once during each swinging cycle of child seat 18. This small push, along with the momentum of the child seat 18, is enough to keep the child swing 10 operating until the spring 94 fully unwinds.

The ratchet wheel 136 includes a circular outer edge formed to include a plurality of inclined drive teeth 140. The toothed ratchet wheel 136 serves as means for transmitting torque generated by the unwinding spring 94 and transmitted by the barrel 110 and one-way clutch 134 to a drive pawl 142 that is pivotably mounted on the hanger arm 16 and configured to pivot and impart pendulum motion to the child seat 18. Ratchet wheel 136 also includes a central plate 144 formed to include a hub 145 having a crankshaft-receiving aperture 146. The bearing 92 in hanger arm 16 is mounted on hub 145 as shown in FIG. 4.

Ratchet wheel 136 is also formed to include a circular cavity 148 which opens toward the barrel 110 and contains the one-way clutch 134. As shown best in FIG. 8, the ratchet wheel 136 includes a circular inner edge 149 around the circular cavity 148 and the one-way clutch 134 is coupled to the spring 94 via barrel 110 and mounted on the crankshaft 84 to engage the circular inner edge 149 of the ratchet wheel 136 to transmit torque from the spring 94 to the escapement mechanism 138. As shown best in FIG. 4, the one-way clutch 134 is mounted on the crankshaft 84 to lie between the barrel 110 and the ratchet wheel 136.

One-way clutch 134 includes a clutch roller ramp 150, a clutch spring ring 151, a plurality of circumferentially spaced-apart spring fingers 152, and a plurality of clutch rollers 154 as shown, for example, in FIGS. 3 and 8. Essentially, the one-way clutch 134 never disengages during the run cycle of child swing 10 except during winding of spring 94. It is within the scope of the present invention to use any suitable unidirectional clutch that engages the ratchet wheel 136 with the crankshaft 84 when the crankshaft 84 is rotated in the spring-unwinding direction but which disengages the ratchet wheel 136 from the crankshaft 84 when the crankshaft 84 is rotated by turning crank handle 20 to wind spring 94 (even if the child seat 18 is still swinging).

One-way clutch 134 is configured to rotate the ratchet wheel 136 in a counterclockwise direction 156 (FIG. 8) as the spring 94 unwinds to rotate the barrel 110 and one-way clutch 134 in the counterclockwise direction 156 about the longitudinal axis of the crankshaft 84. However, when the crank handle 20 is used to turn the crankshaft 84 in a clockwise direction 158 (FIG. 8) to wind the spring 94, the one-way clutch 134 rotates freely within the ratchet wheel 136. As a result, clockwise rotation of the one-way clutch 134 rotates the barrel 110 to wind the spring 94 without rotating the ratchet wheel 136 about the longitudinal axis of the crankshaft 84. Essentially, the one-way clutch 134 engages the circular inner edge 149 (FIG. 8) of the ratchet wheel 136 to lock the ratchet wheel 136 to rotate with barrel 110 during unwinding of the spring 94 and disengages the circular inner edge 149 of the ratchet wheel 136 to allow the barrel 110 to rotate without rotating the ratchet wheel 136 during winding of the spring 94.

As shown in FIG. 3, the escapement mechanism 138 also includes a floating panel 162 including a ramp 164 for controlling pivoting movement of drive pawl 142 (into and out of engagement with ratchet wheel 136) and a stop pawl 166 pivotably mounted on drop-in panel 162. The floating panel 162 is configured as a modular component to move vertically in clamshell housing 12 relative to the bottom wall of bottom half shell 40 and to lie in spaced-apart parallel relation to the second crankshaft support panel 54. A guide post 167 is mounted on bottom half shell 40 to guide floating panel 162 as it moves up and down in a vertical plane inside housing 12. Guiding post 167 is arranged to engage the side edge 169 of floating panel 162 to prevent rotation of floating panel 162 about the crankshaft axis during unwinding and winding of spring 94.

As shown in FIG. 4, the escapement mechanism 138 and the right hanger arm 16 are modular components that are arranged to lie between these two side-by-side panels 162, 54. The drive pawl 142 and stop pawl 166 included in escapement mechanism 138 alternately engage ratchet wheel 136 during unwinding of spring 94 and thereby cooperate to impart pendulum motion to hanger arm 16 and child seat 18 by using torque that is generated by spring 94 as it unwinds and that is transmitted to the drive pawl 142 from the spring 94 by barrel 110, one-way clutch 134, and ratchet wheel 136 as they rotate about the crankshaft axis. The stop pawl 166 is mounted for pivoting movement on the pivot post 171 formed on floating panel 162.

As shown in FIG. 3, drive pawl 142 includes a mounting portion 168 formed to include an aperture 170 for receiving a pivot pin 172 appended to hanger arm 16, inclined driven teeth 174 formed to serve as engaging means to receive torque from ratchet wheel 136 through engagement with the inclined drive teeth 140 thereon, and a ramp pin 176 for riding on ramp 164 provided on floating panel 162. The stop pawl 166 includes a stop tongue 178 that is shown in FIG. 8 and configured to engage any of the inclined drive teeth 140 on ratchet wheel 136 to block rotation of the ratchet wheel 136 about the axis of crankshaft 84 in the counterclockwise direction 158 during unwinding of spring 94. The teeth 174 and stop tongue 178 are configured to fall into the notches or interdental spaces between the teeth 140 on ratchet wheel 136. The stop pawl 166 also includes an offset weighted portion 180 on one side of pivot post-receiving aperture 182 and a long finger 184 on the other side of pivot post-receiving aperture 182. The long finger 184 includes a cam follower 186 positioned to be engaged by a cam 188 on drive pawl 142 during pivoting of drive pawl 142. A description of how the novel ramp 164 and cam 188 function to hold the drive pawl 142 and stop pawl 166, respectively, in engagement with the ratchet wheel 136 during winding of spring 94 and swinging of child seat 18 is provided below in connection with the discussion of FIGS. 9–12.

Figure 5:
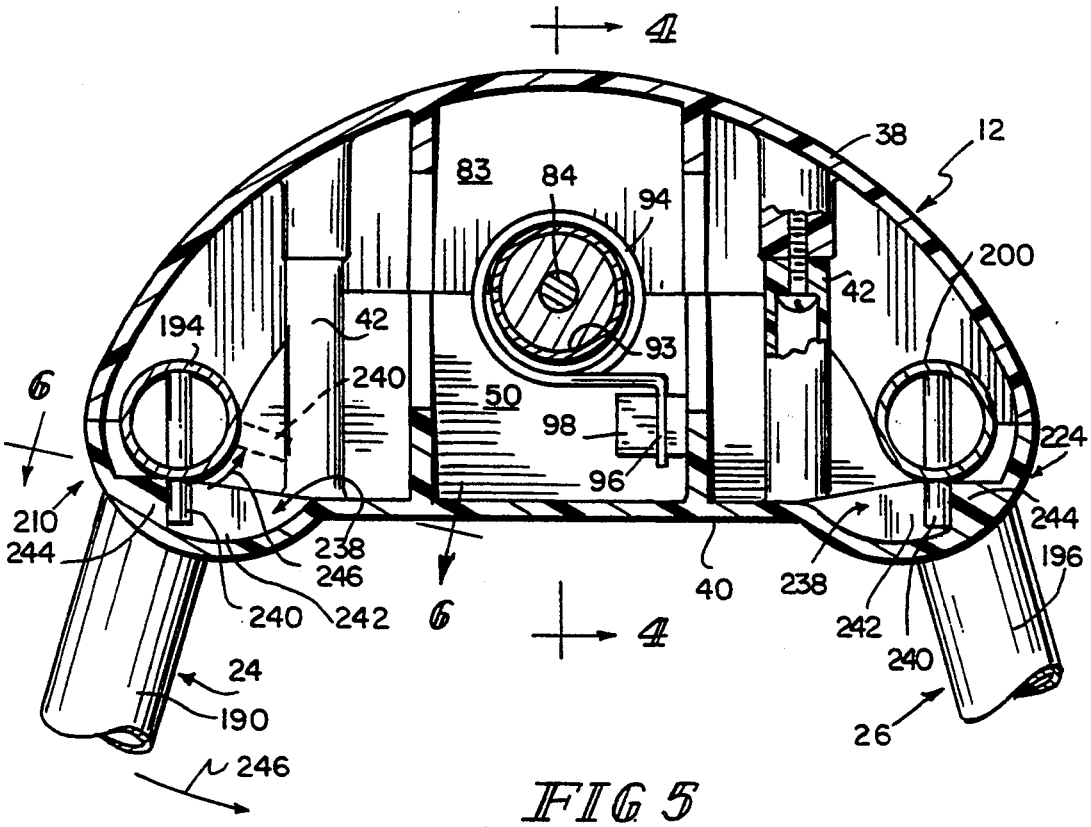
FIG. 5 is a transverse sectional elevation view of the swing motor taken along line 5—5 of FIG. 4, with portions broken away, showing the way in which the front and rear U-shaped support legs are mounted in the swing motor housing on opposite sides of the central crankshaft.
Figure 6:
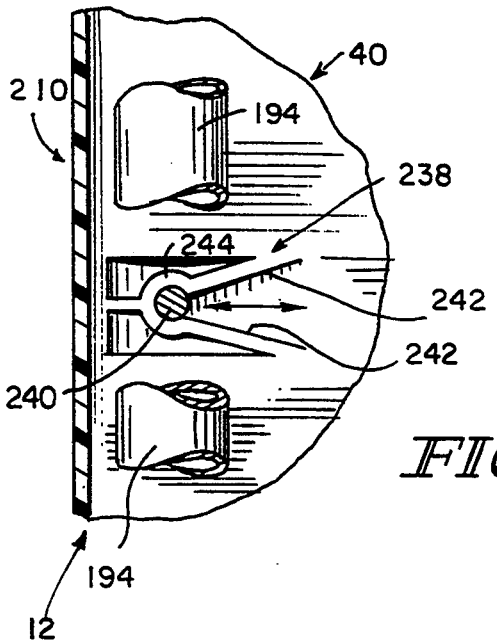
FIG. 6 is a section taken along line 6—6 of FIG. 5 showing a snap-action, pin-receiving slot used to couple the front U-shaped support leg to the swing motor housing.

The manner in which the U-shaped legs 24 and 26 are connected to the clamshell housing 12 is shown in more detail in FIGS. 5 and 6. Front U-shaped leg 24 includes spaced-apart first and second side leg portions 190, 192 and a horizontal top portion 194 extending therebetween as shown in FIGS. 1 and 2. Rear U-shaped leg 26 includes spaced-apart first and second side leg portions 196, 198 and a horizontal top portion 200 extending therebetween. When mounted in the clamshell housing 12, the horizontal top portions 194, 200 are arranged to extend along the length of housing 12 and lie in spaced-apart parallel relation to the crankshaft 84. The U-shaped legs 24, 26 stiffen, strengthen, and support the elevated clamshell housing 12 in such a way as to enhance the stability of the child swing 18.

The longitudinally extending troughs formed in the bottom half shell 40 and configured to support the top portions 194, 200 of each of the front and rear U-shaped legs 24, 26 are shown best in FIG. 3. For example, the horizontally extending top portion 194 of front U-shaped leg 24 is supported for rotation about its longitudinal axis in a first trough lying along the front edge 210 of the bottom half shell 40. This front trough is defined by channel 212 formed in left end wall 56, channel 214 formed in left spring guard support wall 48, channel 216 formed in right spring guard support wall 46, channel 220 formed in second crankshaft support panel 54, and channel 222 formed in right end wall 64. Matching channels are formed where needed in the top half shell 38 along its front edge to trap the top portion 194 of U-shaped front leg 24 in a rotatable position inside clamshell housing 12.

Similarly, the horizontally extending top portion 200 of rear U-shaped leg 26 is supported for rotation about its longitudinal axis in a second trough lying along the rear edge 224 of the bottom half shell 40. This rear trough is defined by channel 226 formed in left end wall, channel 228 formed in left spring guard support wall 48, channel 230 formed in right spring guard support wall 46, channel 234 formed in second crankshaft support panel 54, and channel 236 formed in right end wall 64. Matching channels are also formed where needed in the top half shell 38 along its rear edge to trap the top portion 200 of rear U-shaped leg 26 in a rotatable position inside clamshell housing 12.

As shown best in FIGS. 3, 5, and 6, the bottom half shell 40 is formed to include a plurality of snap locks 238 for gripping locking pins 240 appended to the horizontally extending top portions 194, 200 of each of the front and rear U-shaped legs 24, 26. Engagement of the locking pins 240 in the snap locks 238 cause the top portions 194, 200 to be locked to the bottom half shell 40 and fix the front and rear U-shaped legs 24, 26 in their locked, spread, ready-to-use position shown in FIGS. 1 and 5. Each snap lock 238 is ideally formed as an integral part of the bottom half shell 40 and includes a pair of guide walls 242 that converge toward a snap retention collar 244 which is sized and configured to receive a front or rear leg locking pin 240 therein. As shown in FIG. 3, the bottom half shell 40 is formed to include two spaced-apart snap locks 238 along front edge 210 for receiving and retaining the two longitudinally spaced-apart locking pins 240 appended to the top portion 194 of front V-shaped leg 24 and two spaced-apart snap locks 238 along rear edge 224 for receiving and retaining the two longitudinally spaced-apart locking pins 240 appended to the top portion 200 of rear U-shaped leg 26.

In use, as shown in FIGS. 5 and 6, the locking connection between the locking pins 240 and snap locks 238 is established and released by rotating the top portion of the U-shaped leg assembly about its longitudinal axis and in its longitudinally extending trough to cause the mounting pins 240 to engage and disengage the snap retention collars 244. As shown in FIG. 5, the front U-shaped leg 24 can be pivoted in a counterclockwise direction 246 about the longitudinal axis of top portion 194 to turn the mounting pin 240 from its snap-locked solid-line position to its released dotted-line position. In the released position, the locked connection between the front leg 24 and the clamshell housing 12 is disengaged so that the front leg 24 can be pivoted in its longitudinally extending trough to its folded travel or storage position shown in FIG. 2. Of course, the front leg 24 can be rotated in an opposite clockwise direction in its longitudinally extending trough to turn the mounting pins 240 from their released positions to their snap-locked positions to establish a locked connection between the front leg 24 and the clamshell housing 12. As shown in FIG. 5, each leg 24, 26 can be locked and unlocked independently using this convenient "turn-to-lock" mechanism. The converging guide rails 242 adjacent to each snap retention collar 244 help to guide the pivoting mounting pins 240 into the pin-receiving aperture formed in the snap-retention collar 244 to establish a snap-locked connection.

Figure 7:
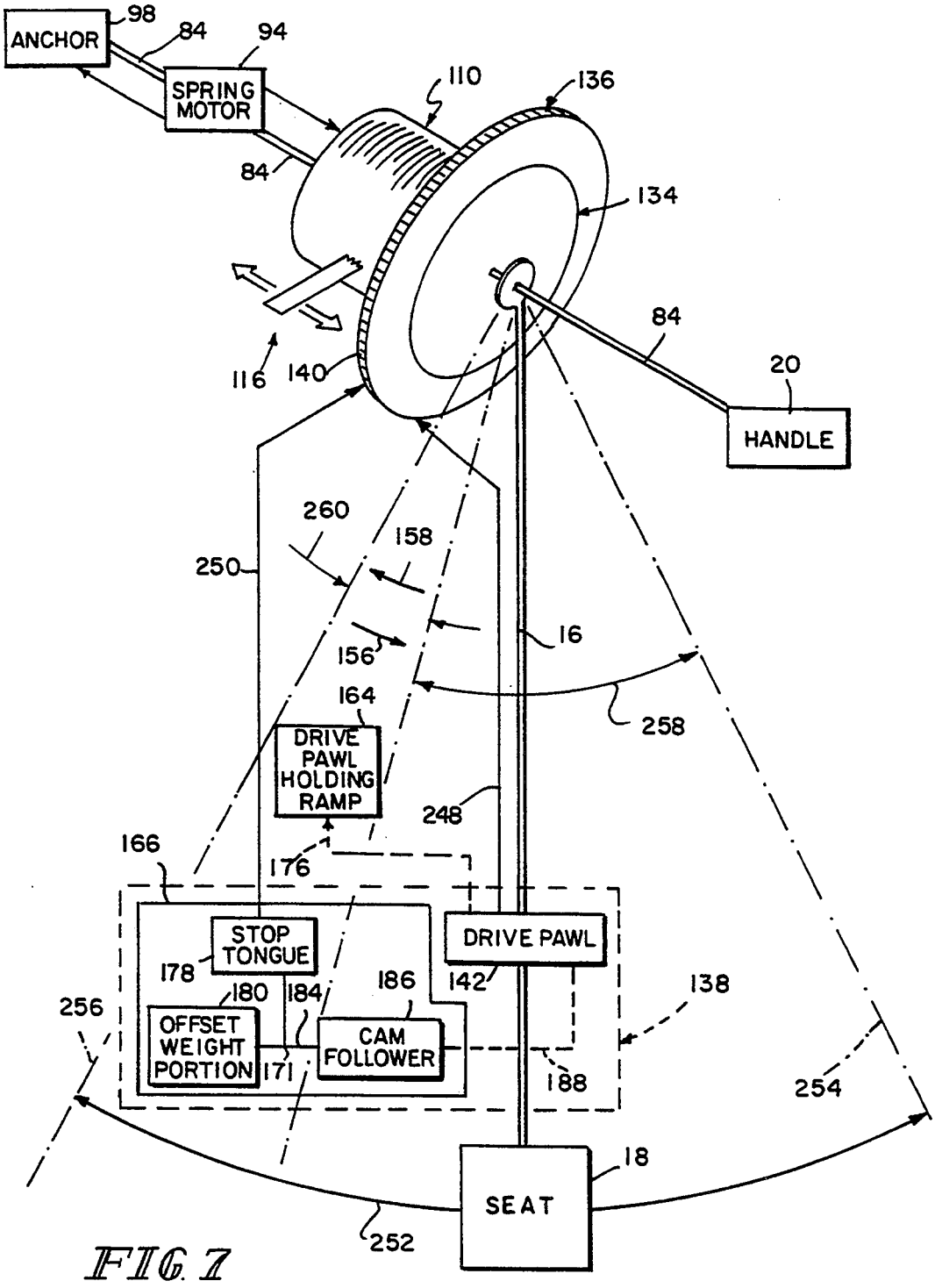
FIG. 7 is a diagrammatic view of the swing motor assembly of FIG. 4 showing the spring motor, the run-time indicator barrel, the ratchet wheel containing the one-way clutch, the hanger arm and seat, the crankshaft and handle, the escapement mechanism including a stop pawl for periodically engaging the ratchet wheel and a drive pawl mounted on one of the hanger arms to periodically engage the ratchet wheel, and the arcuate swinging path of the child seat under the crankshaft.

To aid in understanding the operation of the escapement mechanism 138 and the role it plays in converting torque generated by unwinding of spring 94 into pendulum motion of the swinging child seat 18, a diagrammatic illustration of the escapement mechanism 138 is provided in FIG. 7. Drive pawl 142 is shown to be mounted on hanger arm 16 and connectable to ratchet wheel 136 by lead line 248. In fact, as shown in FIG. 8, drive pawl 142 is pivotably mounted to hanger arm 16 at pivot 172 and includes driven teeth 174 for engaging the drive teeth 140 provided on ratchet wheel 136.

Stop pawl 166 is shown in FIG. 7 in a position which allows the stop tongue 178 to extend along lead line 250 to engage the drive teeth 140 on ratchet wheel 136. In fact, as shown in FIG. 8, stop pawl 166 is pivotably mounted to pivot post 171 on floating panel 162 at pivot 182 and includes one finger having the stop tongue 178 and another finger 184 extending underneath the ratchet wheel 136. Stop pawl 166 also includes an offset weight portion 180 which acts under gravity to pivot the stop pawl 166 away from ratchet wheel 136 about pivot 182 to disengage the stop tongue 178 and the ratchet wheel teeth 140 whenever the drive pawl 142 is moved by the swinging hanger arm 16 to engage ratchet wheel 136. A light gravity-assist tension spring 185 can also be used as shown in FIGS. 7–12 to assist in pivoting the stop pawl 166 about pivot post 171 to disengage the stop tongue 178 and the ratchet wheel 136 at the proper time.

Stop pawl 166 also includes a cam follower 186 arranged on the long finger 184 to engage the cam 188 on drive pawl 142 for a certain period during each swing cycle so that the drive pawl 142 can positively hold the stop pawl 166 in a ratchet wheel-engaging position to block further rotation of the spring-biased ratchet wheel 136 whenever the drive pawl 142 disengages the ratchet wheel 136.

As shown diagrammatically in FIG. 7, the child seat 18 swings back and forth along an arcuate swing path 252 during each swing cycle between a rearwardmost limit 254 and a forwardmost limit 256. The escapement mechanism 138 is configured to allow the child seat 18 to swing freely during a substantial portion of each swing cycle. This free swinging zone is represented by large angle 258. During the entire time that child seat 18 swings in a forward or rearward direction through zone 258, the drive pawl 142 is disengaged from ratchet wheel 136 and child seat 18 is swinging freely in true pendulum fashion. Advantageously, this type of improved escapement mechanism 138 provides a more swing-like sensation for the child seated in the child seat 18 to provide a more comfortable and relaxing ride.

When child seat 18 swings rearwardly in counterclockwise direction 156 through small angle 260 as shown in FIGS. 7 and 8, the ratchet wheel 136 is rotated in that same counterclockwise direction 156 by spring 94 to positively drive the drive pawl 142, thereby giving a short rearward push to hanger arm 16 so that the child seat 18 is driven back along the swing path 252 until it enters free-swinging zone 258. The drive pawl 142 disengages ratchet wheel 136 at the beginning of free-swinging zone 258 because the ramp pin 176 on drive pawl 142 follows the downwardly and rearwardly sloping ramp 164 formed on floating panel 162 owing to the force of gravity on the pivotable drive pawl 142 and thereby falls and pivots away from the ratchet wheel 136. Continued swinging movement of child seat 18 toward rearwardmost limit 254 causes the cam 188 on drive pawl 142 to act against cam follower 186 on stop pawl 166 to pivot the stop pawl 166 about pivot post 171 to cause the stop tongue 178 to engage the ratchet wheel teeth 140 and block further rotation of ratchet wheel 136.

When child seat 18 swings forwardly in clockwise direction 158 through small angle 260 as shown in FIGS. 7 and 8, the forward momentum of the child seat 18 is transferred through the hanger arm 16 and drive pawl 142 to rotate the ratchet wheel 136 in a clockwise direction 158 about the crankshaft axis and against the bias provided by unwinding spring 94. In fact, one advantage of the improved escapement mechanism 138 is that it actually operates to rewind the spring 94 a little bit during each swing cycle because of the movement of drive pawl 142 to positively rotate the ratchet wheel 136 in a clockwise, spring-winding direction 158 once during each swing cycle as the drive pawl 142 moves in direction 158 through small angle 260. Advantageously, this operation of the escapement mechanism 138 conserves spring energy by driving the drive pawl 142 during only a very short period during each swing cycle and adds spring energy by rewinding the spring 94 during each swing cycle to extend the run time of the child swing 10.

Figure 9:
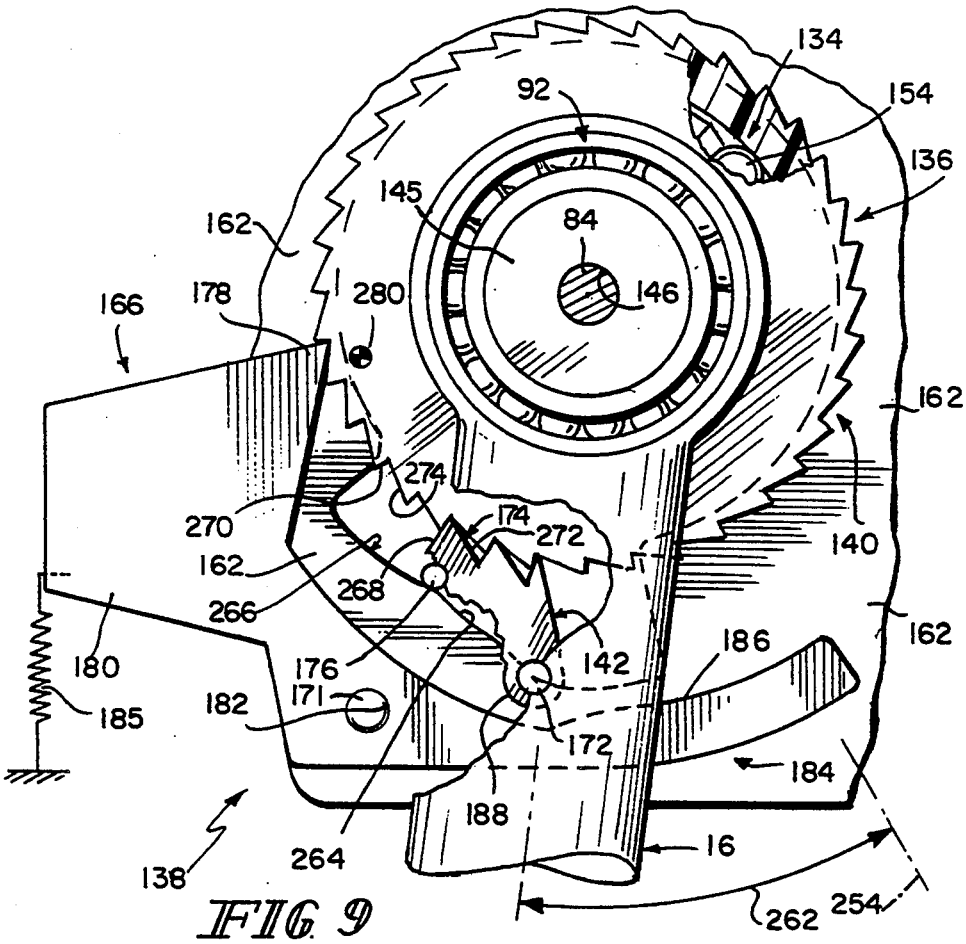
FIG. 9 is a view similar to FIG. 8 but reduced in size showing the position of the stop pawl and drive pawl as the child seat freely swings from its rearwardmost position toward its forwardmost position.

A sequence of operation of child swing 10 is illustrated in FIGS. 9–12 to show the relative movement of the drive pawl 142 and the stop pawl 166 during each swing cycle to convert torque generated by spring 94 as it unwinds into pendulum motion of child seat 18. As shown in FIG. 9, hanger arm 16 has swung through an angle 262 (through free-swinging zone 258) from the rearwardmost limit 254 of the swing path and the ramp pin 176 on drive pawl 142 has run up first slope 264 and onto second slope 266 to urge the driven teeth 174 on drive pawl 142 into engagement with the drive teeth 140 on ratchet wheel 136. Note that only the leading end 268 of each driven tooth 174 on drive pawl 142 engages the leading end 270 of each mating drive tooth 140 on ratchet wheel 136 to transmit drive forces between the ratchet wheel 136 and drive pawl 142. The inclined side 272 of driven teeth 174 never engage the inclined side 274 of drive teeth 140 during any point in the swing cycle. This limited engagement of the teeth 174, 140 allows the escapement mechanism 138 to operate efficiently and very quietly without a lot of the usual tooth-on-tooth friction loss and clicking or ratcheting noises associated with conventional child swing escapement mechanisms.

Figure 10:
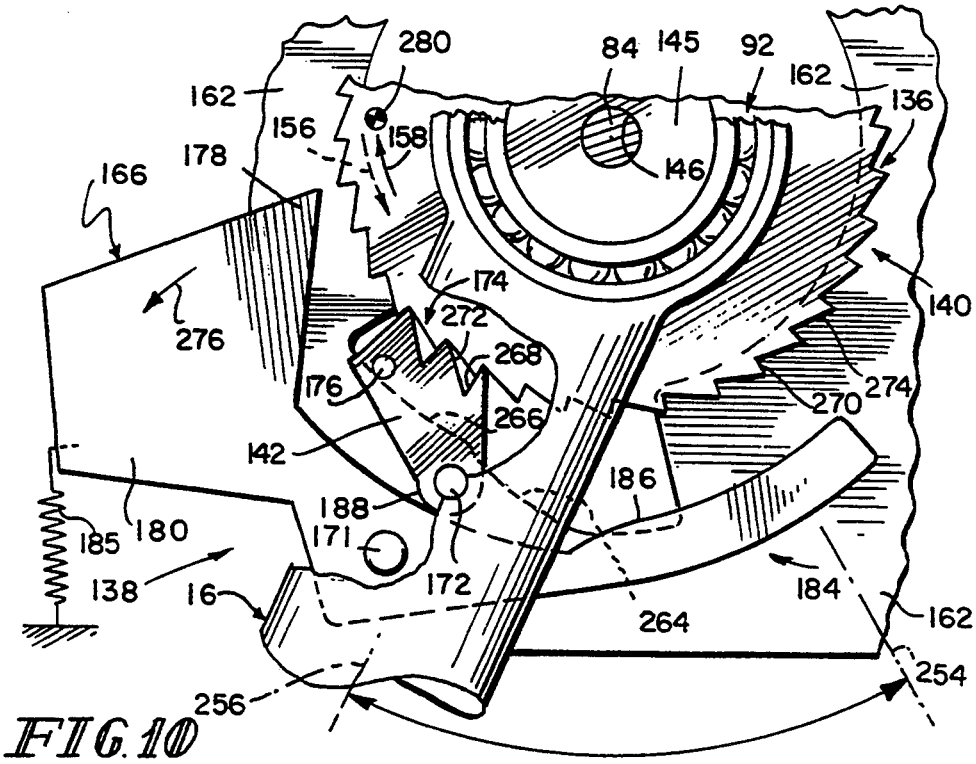
FIG. 10 is a view similar to FIG. 9 showing disengagement of the stop pawl and the ratchet wheel and engagement of the drive pawl and the ratchet wheel as the child seat reaches its forwardmost position and is ready to be driven by the ratchet wheel and drive pawl back toward its rearwardmost position.

As the child seat 18 and hanger arm 16 swing from the position shown in FIG. 9 to the forwardmost limit position 256 shown in FIG. 10, the drive pawl 142 has acted to rotate ratchet wheel 136 in a clockwise direction 158 against the spring 94. This clockwise rotation of ratchet wheel 136 actually rotates the one-way clutch 134 and barrel 110 to rewind the spring 94 a small amount during each swing cycle. This "automatic" rewinding helps to add spring energy (during swinging without manual spring rewinding) and thereby extend the run time of child swing 10. It also helps to cushion the child seat 18 at the forward end of the swing path to avoid any abrupt stopping of the child seat 18 before it begins its rearward swing. As also shown in FIG. 10, cam 188 on drive pawl 142 has disengaged cam follower 186 on stop pawl 166. This causes a number of things to happen. First, the stop tongue 178 is no longer held by the drive pawl 142 in engagement with the drive teeth 140 on ratchet wheel 136 because of the disengagement of cam 188 on drive pawl 142 and cam follower 186 on stop pawl finger 184. Second, the offset weight portion 180 (helped by the optional gravity-assist tension spring 185) applies a moment to the stop pawl 166 which causes it to pivot in direction 276 about pivot post 171 to the position shown in FIG. 10.

Figure 11:
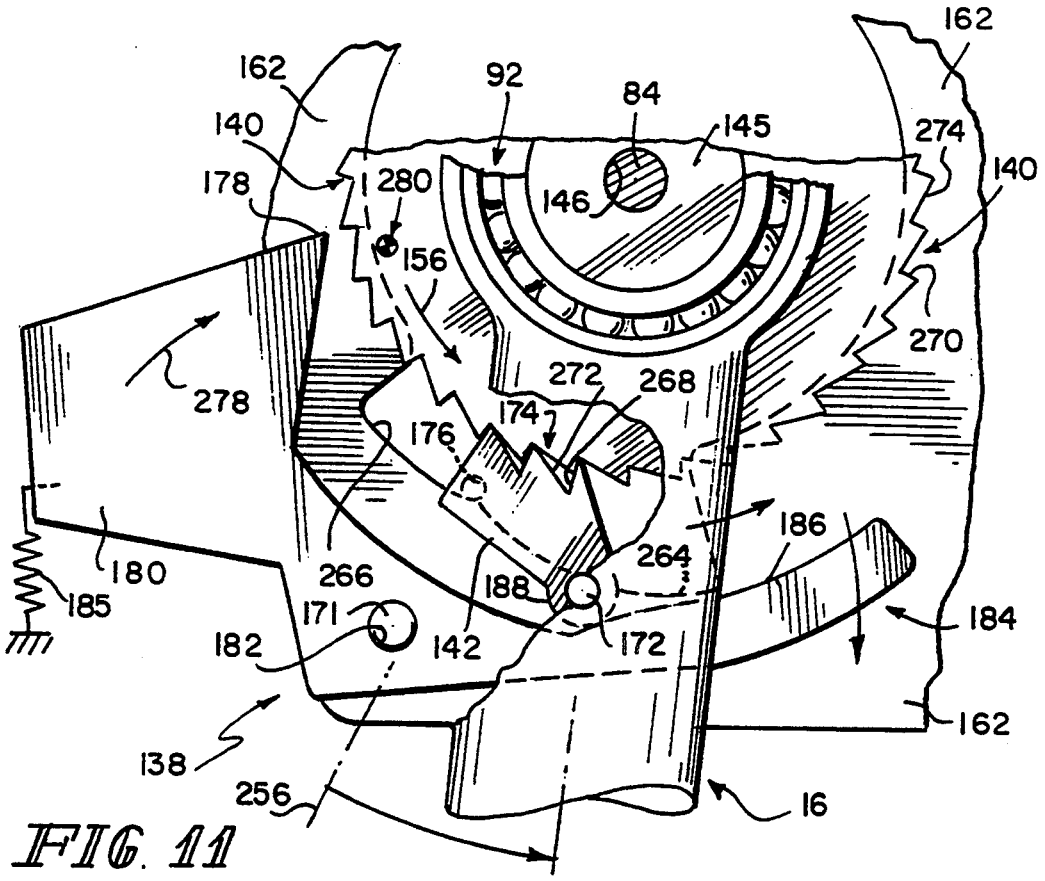
FIG. 11 is a view similar to FIG. 10 showing turning of the spring-biased ratchet wheel about the crankshaft in a counterclockwise direction to push the drive pawl so as to impart pendulum motion to the hanger arm and child seat and swing the child seat in a rearward direction.

During the next stage of the swing cycle, the spring-biased ratchet wheel 136 acts against the drive pawl 142 as it rotates to drive the hanger arm 16 and child seat 18 toward their rearwardmost limit position 254. As the child seat 18 and hanger arm 16 swing from the position shown in FIG. 10 to the position shown in FIG. 11, the ratchet wheel 136 has applied a short duration "push" to the drive pawl 142 and hanger arm 16 to impart pendulum motion to the child seat 18. As shown in FIG. 11, the ramp pin 176 on drive pawl 142 is about to move on ramp 164 from the second slope 266 to the first slope 264. One important function of the second slope 266 on ramp 164 is to provide ramp means for holding the drive pawl 142 in a position engaging the ratchet wheel 136 during winding of the spring 94.

Figure 12:
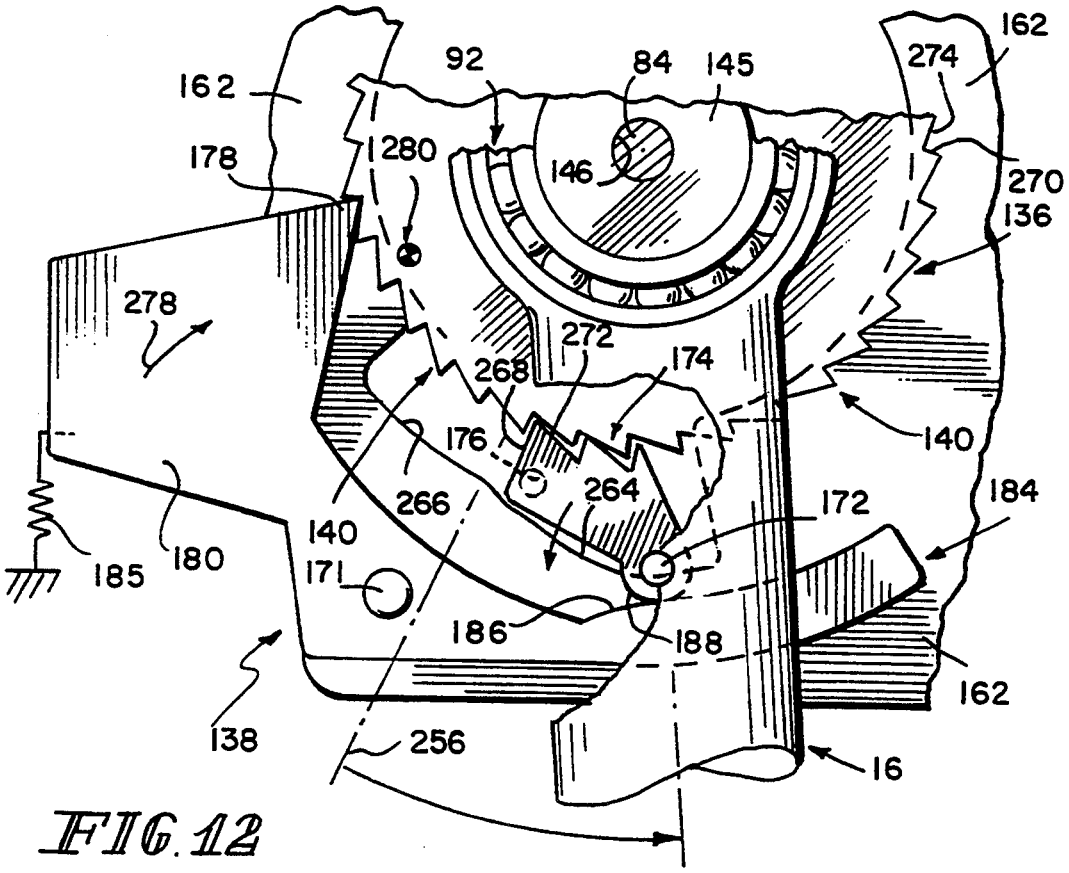
FIG. 12 is a view similar to FIG. 11 showing disengagement of the drive pawl and the ratchet wheel to allow free-swinging movement of the hanger arm and child seat toward its rearwardmost position and engagement of the stop pawl and ratchet wheel to stop further turning of the spring-biased ratchet wheel about the crankshaft.

Importantly, as shown in FIG. 12, the ramp 164 does not hold the drive pawl 142 in engagement with the ratchet wheel 136 during that portion of the swing cycle wherein there is engagement of the stop tongue 178 and the ratchet wheel 136. This is because the first slope 264 slopes downwardly away from ratchet wheel 136 in a rearward direction as shown in FIGS. 8 and 12 to allow the drive pawl 142 to fall under gravity and pivot out of engagement with the ratchet wheel 136 as child seat 18 swings through the entire free-swinging zone 258, which zone 258 is shown diagrammatically in FIG. 7. The improved escapement mechanism 138 operates very quietly because of the long period of time that the drive pawl 142 is disengaged from the ratchet wheel 136 during each swing cycle. Essentially, the novel ramp 164 moves drive pawl 142 (which is carried on the swinging hanger arm 16) into engagement with ratchet wheel only when needed (1) to rewind spring 94 at the end of each forward stroke and (2) to exert pendulum motion to child seat 18 at the beginning of each rearward stroke. The rest of the time the ramp 164 guides the drive pawl to disengage the ratchet wheel 136 and therefore eliminate a lot of the unwelcome ratcheting noise that is associated with conventional child swing escapement mechanisms wherein a drive pawl is always biased into engagement with a ratchet wheel during an entire swing cycle.

As also shown in FIG. 12, once the drive pawl 142 begins to disengage the ratchet wheel 136, the cam 188 on drive pawl 142 has moved to a position where it engages cam follower 186 on stop pawl 166. At this point, stop pawl 166 behaves like a see-saw around pivot post 171 and the cam 188 pushes against cam follower 186 to pivot the stop pawl 166 about pivot post 171 in direction 278 enough to overcome the weight of offset weight portion 180 (and tension of spring 185) and engage the stop tongue 178 and ratchet wheel 136. Such engagement, as before, will serve to block further rotation of the spring-biased ratchet wheel during the period in which the drive pawl 142 remains disengaged from the ratchet wheel 136. It will be understood that the escapement mechanism 138 operates to allow the spring 94 to advance the ratchet wheel 136 by one tooth during each swing cycle as can be seen by comparing the location of marker 280 on ratchet wheel 136 in FIGS. 9 and 12.

Although the invention has been described in detail with reference to certain preferred embodiments, variations and modifications exist within the scope and spirit of the invention as described and defined in the following claims.

We claim:

1. A child swing apparatus comprising a child seat hanging from a child swing frame, a swing motor operable to discharge energy for a predetermined run time, means for conducting energy discharged from the swing motor to the child seat to swing the child seat, the conducting means including a mechanical linkage interconnecting the swing motor and the child seat and means for visually indicating the remaining run time of the swing motor during running of the swing motor to swing the child seat, the indicating means being coupled to and movable on a portion of the mechanical linkage.

2. The apparatus of claim 1, further comprising a housing formed to include a window and wherein the indicating means includes an indicator in the window and means for using energy from the conducting means to move the indicator in the window from a first position representing a fully energized state of the swing motor to a second position representing a deenergized state of the swing motor to display the remaining run time of the swing motor.

3. The apparatus of claim 2, wherein the swing motor includes a spring and means for winding the spring between a relaxed position and a wound position to store energy in the spring and the using means is coupled to the spring to use energy from the spring to move the indicator in the window as the spring unwinds from said position.

4. The apparatus of claim 2, further comprising first stop means for engaging the indicator as the indicator moves from said second position toward said first position to stop further movement of the indicator at the first position and second stop means for engaging the indicator as the indicator moves from said first position toward said second position to stop further movement of the indicator at the second position so that the indicator is movable only between said first and second positions.

5. A child swing motor apparatus comprising a swing motor operable to discharge energy for a predetermined run time, means for conducting energy discharged from the swing motor to a child seat hanging from a child swing frame to swing the child seat, means for visually indicating the remaining run time of the swing motor during running of the swing motor to swing the child seat, the indicating means being coupled to the conducting means, a housing formed to include a window and wherein the indicating means includes an indicator in the window and means for using energy from the conducting means to move the indicator in the window from a first position representing a fully energized state of the swing motor to a second position representing a deenergized state of the swing motor to display the remaining run time of the swing motor, and first stop means for engaging the indicator as the indicator moves from said second position toward said first position to stop further movement of the indicator at the first position and second stop means for engaging the indicator as the indicator moves from said first position toward said second position to stop further movement of the indicator at the second position so that the indicator is movable only between said first and second positions, the first stop means being mounted to the housing and the second stop means being mounted to the using means.

6. A child swing motor apparatus comprising a swing motor operable to discharge energy for a predetermined run time, a casing located in a fixed position adjacent to the swing motor, means for conducting energy discharged from the swing motor to a child seat hanging from a child swing frame to swing the child seat, and means for visually indicating the remaining run time of the swing motor during running of the swing motor to swing the child seat, the indicating means being coupled to the conducting means, and wherein the swing motor includes an elongated spring having first and second ends and a middle portion extending between the first and second ends, means for anchoring the second end of the spring in a fixed position to the casing so that the second end of the spring is unable to move as the spring unwinds between said wound and unwound positions, and means for winding the elongated spring between a relaxed position and a wound position to store energy in the spring and the indicating means is coupled to the first end of the spring and positioned to lie between the spring and the winding means.

7. The apparatus of claim 6, wherein the indicating means includes an indicator and means for moving the indicator from a first position representing a fully energized state of the swing motor to a second position representing a deenergized state of the swing motor as the spring unwinds between said wound and relaxed positions and the moving means is coupled to the first end of the spring.

8. The apparatus of claim 6, wherein a portion of the spring is positioned to lie within the indicator means.

9. A child swing motor apparatus comprising a swing motor operable to discharge energy for a predetermined run time, the swing motor including a spring and means for winding the spring between a relaxed position and a wound position to store energy in the spring, means for conducting energy discharged from the swing motor to a child seat hanging from a child swing frame to swing the child seat, and means for visually indicating the remaining run time of the swing motor during running of the swing motor to swing the child seat, the indicating means being coupled to the conducting means and to the spring, the indicating means including a barrel formed to include external threads, means for supporting the barrel for rotation about an axis in response to unwinding of the spring, a collar ring surrounding the barrel and including means for threadedly engaging the external threads on the barrel to advance the collar ring along the axis of the barrel in response to rotation of the barrel, and an indicator on the collar ring.

10. The apparatus of claim 9, wherein the indicating means further includes stop means for engaging the collar ring as the collar ring advances along the axis of the barrel to establish a limited range of axial movement of the collar ring relative to the barrel.

11. The apparatus of claim 9, wherein the collar ring is formed to include a guide rail-receiving channel therein and the indicating means further includes means for providing a guide rail lying in the guide rail-receiving channel to block rotation of the collar ring about the axis of the barrel as the collar ring advances along the axis of the barrel during unwinding of the spring.

12. An apparatus for swinging a child seat, the apparatus comprising a housing, a swing motor coupled to the housing, the swing motor including a spring and means for winding the spring between a relaxed position and a wound position to store energy in the spring, means for connecting a child seat to the swing motor so that the child seat swings relative to the housing in response to unwinding of the spring, the connecting means including spaced-apart first and second hanger arms coupled to the child seat and means for indicating a current position of the spring between said wound and relaxed positions as the spring unwinds from said wound position so that the amount of stored energy currently left in the spring is displayed as the swing unwinds during swinging of the child seat, the indicating means including an indicator formed to include an aperture, the spring extending through the aperture formed in the indicator.

13. The apparatus of claim 12, wherein the housing is formed to include a window, the indicator lies in the window, and the indicating means further includes means for moving the indicator in the window and along the spring as the spring unwinds between said wound and relaxed positions.

14. The apparatus of claim 12, wherein the indicating means includes an indicator and means for moving the indicator relative to the housing as the spring unwinds between said wound and relaxed positions.

15. The apparatus of claim 14, wherein the moving means includes a support member carrying the indicator and means on the support member for advancing the indicator relative to the housing in response to movement of the spring between said wound and relaxed positions.

16. The apparatus of claim 12, wherein the housing includes a top shell and a bottom shell coupled to the top shell to define an interior region therebetween, the indicating means is situated in the interior region, and the top shell is formed to include means for viewing the indicating means during unwinding of the spring.

17. The apparatus of claim 16, wherein the top shell is formed to include a window defining the viewing means, the indicating means includes an indicator in the window and means for moving the indicator in the window as the spring unwinds between said wound and relaxed positions, and the spring is coupled to the moving means.

18. The apparatus of claim 12, wherein the indicating means is positioned to lie between the first and second hanger arms.

19. An apparatus for swinging a child seat, the apparatus comprising a housing formed to include a window, a swing motor coupled to the housing, the swing motor including a spring and means for winding the spring between a relaxed position and a wound position to store energy in the spring, means for connecting a child seat to the swing motor so that the child seat swings relative to the housing in response to unwinding of the spring, and means for indicating a current position of the spring between its wound and relaxed positions as the spring unwinds from its wound position so that the amount of stored energy currently left in the spring is displayed as the swing unwinds during swinging of the child seat, the indicating means including an indicator in the window and means for moving the indicator in the window as the spring unwinds between its wound and relaxed positions, the moving means including a barrel formed to include external threads and means for supporting the barrel for rotation about an axis in response to unwinding of the spring from said wound position to said relaxed position, the indicating means further including collar means for engaging the external threads on the barrel to cause the indicator to move along the axis and in the window in response to rotation of the barrel about the axis.

20. The apparatus of claim 19, wherein the housing includes a guide rail situated in spaced-apart relation to the barrel and the collar means is formed to include a channel receiving the guide rail therein.

21. The apparatus of claim 19, wherein a straight guide rail lying in spaced-apart parallel relation to the axis of the barrel is coupled to the housing and the collar means includes means for engaging the straight guide rail to block rotation of the indicator about the axis during rotation of the barrel about the axis without inhibiting movement of the collar means and the indicator in axial directions along the straight guide rail.

22. The apparatus of claim 19, wherein the indicating means further includes stop means for engaging the collar means to limit movement of the indicator along the axis to establish a first limit position of the collar means upon movement of the spring to said wound position and a second limit position of the collar means upon movement of the spring to said relaxed position and the stop means is mounted on at least one of the housing and the barrel.

23. An apparatus for swinging a child seat, the apparatus comprising a housing, a swing motor coupled to the housing, the swing motor including a spring and means for winding the spring between a relaxed position and a wound position to store energy in the spring, means for connecting a child seat to the swing motor so that the child seat swings relative to the housing in response to unwinding of the spring, the connecting means including spaced-apart first and second hanger arms coupled to the child seat and means for indicating a current position of the spring between said wound and relaxed positions as the spring unwinds from said wound position so that the amount of stored energy currently left in the spring is displayed as the swing unwinds during swinging of the child seat, the indicating means being positioned to lie between the first and second hanger arms, the indicating means including an indicator and means for moving the indicator relative to the housing as the spring unwinds between said wound and relaxed position, the moving means including a support member carrying the indicator and means on the support member for advancing the indicator relative to the spring in response to movement of the spring between said wound and relaxed positions, the advancing means including a spiraling exterior thread on the support member and a mating spiraling interior thread on the indicator.

24. An apparatus for swinging a child seat, the apparatus comprising a housing, a swing motor coupled to the housing, the swing motor including a spring and means for winding the spring between a relaxed position and a wound position to store energy in the spring, means for connecting a child seat to the swing motor so that the child seat swings relative to the housing in response to unwinding of the spring, and means for indicating a current position of the spring between said wound and relaxed positions as the spring unwinds from said wound position so that the amount of stored energy currently left in the spring is displayed as the swing unwinds during swinging of the child seat, the indicating means including an indicator and means for moving the indicator relative to the housing as the spring unwinds between said wound and relaxed positions, the moving means including a barrel, means for supporting the barrel for rotation about an axis in response to unwinding of the spring, and means for advancing the indicator along the axis in response to rotation of the barrel about the axis during unwinding of the spring.

25. The apparatus of claim 24, wherein the indicating means further includes stop means for limiting movement of the indicator along the axis.

26. The apparatus of claim 24, wherein the indicating means further includes first stop means on the housing for engaging the advancing means to stop movement of the indicator along the axis upon movement of the spring to said relaxed position and second stop means on the barrel for engaging the advancing means to stop movement of the indicator along the axis upon movement of the spring to said wound position.

27. An apparatus for swinging a child seat, the apparatus comprising a housing, a swing motor coupled to the housing, the swing motor including a spring and means for winding the spring between a relaxed position and a wound position to store energy in the spring, means for connecting a child seat to the swing motor so that the child seat swings relative to the housing in response to unwinding of the spring, and means for indicating a current position of the spring between said wound and relaxed positions as the spring unwinds from said wound position so that the amount of stored energy currently left in the spring is displayed as the swing unwinds during swinging of the child seat, the winding means including a rotatable crankshaft in the housing, the indicating means including a barrel, means for supporting the barrel for rotation about an axis of the rotatable crankshaft, an indicator, and means for advancing the indicator along the axis of the rotatable crankshaft in response to rotation of the barrel about the axis of the rotatable crankshaft, the spring including one end anchored to the housing, another end anchored to the barrel, and coil means between said ends for rotating the barrel about the axis of the rotatable crankshaft during unwinding of the spring.

28. The apparatus of claim 27, wherein the swing motor further includes escapement means for using torque generated by the spring as the spring unwinds to impart pendulum motion to the child seat, the escapement means includes a rotatable ratchet wheel mounted on the crankshaft, and the winding means includes a one-way clutch mounted on the barrel to rotate with the barrel and engage the ratchet wheel.

29. The apparatus of claim 28, wherein the barrel, one-way clutch, and ratchet wheel are situated in the housing, the crankshaft extends along the axis of rotation of the barrel, one-way clutch, and ratchet wheel and includes a distal end extending outside of the housing, and the winding means further includes a crank handle coupled to the distal end of the crankshaft to lie outside of the housing and arranged to lie on an opposite side of the ratchet wheel from the barrel.

30. An apparatus for swinging a child seat, the apparatus comprising a swing motor including a windable spring and escapement means for using torque generated by the spring as the spring unwinds to impart pendulum motion to the child seat, the escapement means including a ratchet wheel having an inner edge, and means for winding the spring between a relaxed position and a wound position to store energy in the spring, the winding means including a crankshaft, means for supporting the crankshaft for rotation about a central axis of the crankshaft, and a one-way clutch coupled to the spring and mounted on the crankshaft to engage the inner edge of the ratchet wheel to transmit torque from the spring to the escapement means.

31. The apparatus of claim 30, wherein the supporting means includes a housing and means in the housing for holding the crankshaft and the spring includes one end anchored to the housing, another end anchored to the one-way clutch, and coil means between said ends for rotating the one-way clutch about the crankshaft during unwinding of the spring.

32. The apparatus of claim 31, wherein the one-way clutch includes means for rotating the ratchet wheel about the crankshaft without rotating the crankshaft about said central axis in response to unwinding of the spring and means for indicating a current position of the spring between said wound and relaxed positions as the spring unwinds from said wound position so that the amount of stored energy currently left in the spring is displayed as the swing unwinds during swinging of the child seat.

33. The apparatus of claim 32, wherein the housing is formed to include an edge, the indicating means includes a run-time indicator adjacent to the edge and means for moving the run-time indicator adjacent to the edge as the spring unwinds between said wound and relaxed positions to display the amount of stored energy currently left in the spring, and said another end of the spring is coupled to the moving means to anchor the spring to the oneway clutch.

34. The apparatus of claim 30, wherein the winding means further includes means for rotating the crankshaft to rotate the one-way clutch inside the inner edge of the ratchet wheel without rotating the ratchet wheel so that the one-way clutch rotates to wind the spring to said wound position without rotating the ratchet wheel.

35. The apparatus of claim 30, wherein the ratchet wheel further includes a toothed outer edge, the escapement means further includes a swing arm coupled to the crankshaft and a pawl mechanism engaging the toothed outer edge and the swing arm.

36. An apparatus for swinging a child seat, the apparatus comprising a swing motor including a windable spring, means for winding the spring between a relaxed position and a wound position to store energy in the spring, escapement means for using torque generated by the spring as the spring unwinds to impart pendulum motion to the child seat, the escapement means including a ratchet wheel, means for supporting the ratchet wheel for rotation about an axis, means for rotating the ratchet wheel about the axis in a first direction in response to unwinding of the spring, drive means for using rotation of the ratchet wheel in the first direction to impart pendulum motion to a hanger arm carrying the child seat, the drive means including a drive pawl pivotably connected to the hanger arm for pivoting movement between an engaged position engaging the ratchet wheel to cause driven pendulum movement of the child seat and a disengaged position disengaging the ratchet wheel to permit free-swinging pendulum movement of the child seat, and stop means for blocking rotation of the ratchet wheel about the axis during free-swinging pendulum motion of the child seat to prevent unwinding of the spring during disengagement of the drive pawl and the ratchet wheel, and ramp means for holding the drive pawl in its engaged position engaging the ratchet wheel during winding of the spring without holding the drive pawl in its engaged position during engagement of the stop means and the ratchet wheel and concurrent free-swinging pendulum motion of the child seat.

37. The apparatus of claim 36, further comprising a housing formed to include an interior region containing the escapement means, and wherein the ramp means is mounted in the interior region of the housing to lie adjacent to the ratchet wheel and the drive pawl includes a proximal end pivotably coupled to the hanger arm, tooth means for engaging the ratchet wheel, and pin means for periodically engaging the ramp means during swinging of the child seat to hold the tooth means in engagement with the ratchet wheel.

38. The apparatus of claim 37, wherein the housing includes a bottom wall and the ramp means includes an upstanding member having a pin means-engaging ramp and means for mounting the upstanding member on the bottom wall to position the pin means-engaging ramp in the path of the pin means so that the pin means rides on the pin means-engaging ramp at the end of one stroke of the child seat along a swinging path of the child seat.

39. The apparatus of claim 36, wherein the stop means includes a stop pawl and means for pivotably mounting the stop pawl adjacent to the ratchet wheel for pivoting movement between an engaged position engaging the ratchet wheel to block rotation of the ratchet wheel about the axis in the first direction and a disengaged position disengaging the ratchet wheel to permit rotation of the ratchet wheel in the first position to drive the drive paw and the hanger arm appended thereto, the stop pawl includes tongue means for engaging the ratchet wheel and a cam follower, and the drive pawl includes cam means for engaging the cam follower to urge the tongue means of the stop pawl into engagement with the ratchet wheel to hold the stop pawl in said engaged position during free-swinging pendulum motion of the child seat to prevent unwinding of the spring during disengagement of the drive pawl and the ratchet wheel.

40. A child swing motor apparatus comprising a swing motor operable to discharge energy for a predetermined run time, means for conducting energy discharged from the swing motor to a child seat hanging from a child swing frame to swing the child seat, and means for visually indicating the remaining run time of the swing motor during running of the swing motor to swing the child seat, the indicating means being coupled to the conducting means, the conducting means including a one-way clutch and the indicating means being coupled to the one-way clutch.

41. The apparatus of claim 40, wherein the swing motor includes a crankshaft, a crank handle appended to the crankshaft, and an escapement mechanism mounted on the crankshaft, and the one-way clutch is positioned to lie between the indicating means and the escapement mechanism.

42. The apparatus of claim 41, wherein the child seat includes a hanger arm coupled to the escapement mechanism and positioned to lie between the crank handle and the indicating means.

43. The apparatus of claim 40, wherein the swing motor includes a crankshaft, the conducting means includes a ratchet wheel coupled to the crankshaft, and the indicating means is coupled to the crankshaft and arranged to lie adjacent to the ratchet wheel.

44. The apparatus of claim 43, wherein the swing motor includes a spring, the indicating means includes a rotatable barrel coupled to the spring and an indicator coupled to the rotatable barrel, and the conducting means further includes a one-way clutch coupled to the crankshaft, ratchet wheel, and rotatable barrel.

45. A child swing motor apparatus comprising a swing motor operable to discharge energy for a predetermined run time, means for conducting energy discharged from the swing motor to a child seat hanging from a child swing frame to swing the child seat, and means for visually indicating the remaining run time of the swing motor during running of the swing motor to swing the child seat, the indicating means being coupled to the conducting means, and wherein the swing motor includes a spring and means for winding the spring between a relaxed position and a wound position to store energy in the spring and the indicating means is coupled to the spring and positioned to lie between the spring and the winding means, the indicating means including an indicator and means for moving the indicator from a first position representing a fully energized state of the swing motor to a second position representing a deenergized state of the swing motor as the spring unwinds between said wound and relaxed positions, the moving means including a rotatable barrel coupled to the spring and to the winding means and an indicator coupled to the rotatable barrel.

46. The apparatus of claim 45, wherein the rotatable barrel is rotatable about an axis and is formed to include external threads, the moving means further includes a collar ring surrounding the barrel and including means for threadedly engaging the external threads on the barrel to advance the collar ring along the axis of the barrel in response to rotation of the barrel, and the indicator is appended to the collar ring.

47. A child swing motor apparatus comprising a swing motor operable to discharge energy for a predetermined run time, means for conducting energy discharged from the swing motor to a child seat hanging from a child swing frame to swing the child seat, and means for visually indicating the remaining run time of the swing motor during running of the swing motor to swing the child seat, the indicating means being coupled to the conducting means, and wherein the swing motor includes a spring and means for winding the spring between a relaxed position and a wound position to store energy in the spring and the indicating means is coupled to the spring and positioned to lie between the spring and the winding means, the housing including a top shell and a bottom shell coupled to the top shell to define an interior region therebetween, the indicating means being situated in the interior region, and the top shell being formed to include means for viewing the indicating means during unwinding of the spring.

48. The apparatus of claim 47, wherein the top shell is formed to include a window defining the viewing means and the indicating means includes an indicator in the window and means for moving the indicator in the window as the spring unwinds between its wound and relaxed positions, and the spring is coupled to the moving means.

49. A child swing motor apparatus comprising a swing motor operable to discharge energy for a predetermined run time, means for conducting energy discharged from the swing motor to a child seat hanging from a child swing frame to swing the child seat, and means for visually indicating the remaining run time of the swing motor during running of the swing motor to swing the child seat, the indicating means being coupled to the conducting means, and wherein the swing motor includes a spring and means for winding the spring between a relaxed position and a wound position to store energy in the spring and the indicating means is coupled to the spring and positioned to lie between the spring and the winding means, the winding means including a crankshaft, a crank handle appended to the crankshaft, and an escapement mechanism mounted on the crankshaft and wherein the indicating means is mounted on the crankshaft and coupled to the escapement mechanism.

50. The apparatus of claim 49, wherein the escapement mechanism includes a rotatable ratchet wheel mounted on the crankshaft, the indicating means includes a rotatable barrel coupled to the spring motor and an indicator coupled to the rotatable barrel, and the winding means further includes a one-way clutch mounted on the rotatable barrel to rotate with the rotatable barrel and engage the ratchet wheel.

51. A child swing motor apparatus comprising a swing motor operable to discharge energy for a predetermined run time, the swing motor includes a windable spring, means for conducting energy discharged from the swing motor to a child seat hanging from a child swing frame to swing the child seat, and means for visually indicating the remaining run time of the swing motor during running of the swing motor to swing the child seat, the indicating means including a threaded indicator support member coupled to the windable spring, an indicator threadedly coupled to the threaded indicator support member for movement back and forth along the threaded indicator support member, a stop tab appended to the threaded indicator support member, and means on the indicator for engaging the stop tab to limit further movement of indicator along the threaded indicator support member, thereby preventing overwinding of the windable spring.

52. The apparatus of claim 51, wherein the threaded indicator support member includes a barrel formed to include external threads and means for supporting the barrel for rotation about an axis in response to unwinding of the windable spring, the stop tab is appended to one end of the barrel, the indicator includes a collar engaging the external threads on the barrel and an indicator flap on the collar, and the engaging means includes a stop member appended to the collar and arranged to face toward the stop tab on the barrel.

53. The apparatus of claim 52, further comprising a housing coupled to the swing motor, and wherein the housing includes a guide rail situated in spaced-apart relation to the barrel and the collar is formed to include a channel receiving the guide rail therein.

* * * * *